United States Patent [19]

Warner

[11] 3,986,792

[45] Oct. 19, 1976

[54] VIBRATION DAMPENING DEVICE DISPOSED ON A SHROUD MEMBER FOR A TWISTED TURBINE BLADE

[75] Inventor: Ronald E. Warner, Media, Pa.

[73] Assignee: Westinghouse Electric Corporation, Pittsburgh, Pa.

[22] Filed: Mar. 3, 1975

[21] Appl. No.: 554,798

[52] U.S. Cl. ..... 416/190; 416/191; 416/192; 416/500

[51] Int. Cl.[2] ..... F01D 5/10; F01D 5/22

[58] Field of Search ..... 416/190, 191, 195, 196, 416/192, 500

[56] References Cited

UNITED STATES PATENTS

| | | | |
|---|---|---|---|
| 835,471 | 11/1906 | Rotter | 416/192 |
| 1,371,328 | 3/1921 | Schneider | 416/191 |
| 2,347,034 | 4/1944 | Doran | 416/191 |
| 2,391,623 | 12/1945 | Heppner | 416/191 |
| 2,510,734 | 6/1950 | Bodger | 416/190 |
| 2,610,823 | 9/1952 | Knowlton | 416/190 |
| 3,795,462 | 3/1974 | Trumpler | 416/196 |

FOREIGN PATENTS OR APPLICATIONS

| | | | |
|---|---|---|---|
| 1,374,917 | 8/1964 | France | 416/190 |
| 1,300,577 | 8/1969 | Germany | 416/191 |
| 38,086 | 3/1968 | Japan | 416/191 |
| 260,448 | 11/1926 | United Kingdom | 416/189 |

*Primary Examiner*—Everette A. Powell, Jr.
*Attorney, Agent, or Firm*—G. H. Telfer

[57] ABSTRACT

A vibration, damper, or snubber device is disposed on the radially outward surface of a shroud member mounted on a turbine rotor. The rotor has an annular array of twisted blades connected together to form blade groups by a first and a second shroud member. The vibration damper, or snubber, is mounted on the first shroud member and extends therefrom across a gap between the shroud members to circumferentially overlap a portion of the second shroud member. A predetermined axial gap is defined between a portion of the second shroud and the snubber. When an untwist motion is imposed upon the blades due to rotation of the rotor, the axial gap closes and an abutment between the snubber and the second shroud occurs to inhibit further untwist motion and to simultaneously provide a friction interface to inhibit circumferential motion between the second shroud and the vibration damper.

5 Claims, 5 Drawing Figures

VIBRATION DAMPENING DEVICE DISPOSED ON A SHROUD MEMBER FOR A TWISTED TURBINE BLADE

BACKGROUND OF THE INVENTION

1. Field of the Invention

This invention relates to vibration dampers for shrouded turbine blades, and especially to dampers to inhibit both untwist motion imposed on the blades and circumferential motion between shrouded blade groups.

2. Description of the Prior Art

As is known to those skilled in the art of steam power generation, a steam turbine comprises a rotating member having mounted thereon a plurality of annular arrays of rotating blades alternating between arrays of stationary nozzles mounted within a casing surrounding the rotor. High pressure, high temperature steam is confined and guided within the casing and into the rotating blades by the nozzles to convert the energy of the steam to rotational mechanical energy.

The rotating blades comprise a root portion securely fastened to the rotor and a radially extending portion having an air foil cross section. Such blades are designed and manufactured so as to change shape and angle as the blade extends radially outward, so as to accommodate changes in linear speed of the blade as one advances from its root towards its tip. It has been known in the art that these twisted blades tend to untwist as the rotor spins at high speeds due to the imposition of centrifugal force thereon. As shown in U.S. Pat. No. 2,510,734, such untwisting action can be utilized to provide vibration damping.

As shown in the last mentioned U.S. patent and in the patent to Trumpler, U.S. Pat. No. 3,795,462, issued to the assignee of the present invention, frictional interfaces are provided between groupings of blades so that the imposition of the untwist force exerts frictional forces along the last mentioned interfaces which inhibit vibration forces imposed on the blades.

SUMMARY OF THE INVENTION

This invention discloses a rotor having an annular array of substantially radially extending twisted blades thereon, each of the blades terminating in a radially outward extending tenon member. A first and a second shroud member each engages a predetermined plurality of tenons to define within the annular array a first and a second blade group. Both shrouds have disposed along the axially upstream edge thereof a circumferentially extending step comprising a substantially radial face and a substantially axially extending lip. A vibration damper device, or snubber, is disposed on the radially outward surface of the first shroud member and securely affixed to the face portion thereof. The snubber extends in a circumferential direction so as to circumferentially overlap a portion of the second shroud and to define a predetermined axial clearance between the face of the second shroud and the snubber. When the blades twist due to the imposition of the untwist force caused by centrifugal forces of operation, the predetermined axial clearance closes and an abutment between the snubber and the face of the second shroud occurs. The abutment therebetween inhibits further motion of the blade group due to the untwist forces and simultaneously provides a friction interface to inhibit circumferential motion between the blade groups.

It is an object of this invention to provide a blade vibration damper, or snubber, mounted on the radially outward portion of the blade shroud to inhibit both the untwist motion due to operation of the rotor and to inhibit circumferential motion of blade groups relative to each other. It is a further object of this invention to provide in a circumferential step disposed on the axially upstream edge of adjacent shroud members, a snubber securely affixed to the first shroud member disposed so as to circumferentially overlap a portion of the second shroud member, and to define an axial clearance of the predetermined magnitude between the snubber and the second shroud. Imposition of untwist forces on the blade groups narrows the predetermined axial clearance and an abutment between the snubber and the second shroud further inhibits untwist motion and also inhibits circumferential motion between the blade groups. Other objects of this invention will be made clear from the following description of the preferred embodiments.

BRIEF DESCRIPTION OF THE DRAWINGS

The invention will be more fully understood from the following detailed description of the preferred embodiment taken in connection with the accompanying drawings in which.

DESCRIPTION OF THE PREFERRED EMBODIMENTS

Figure 1:
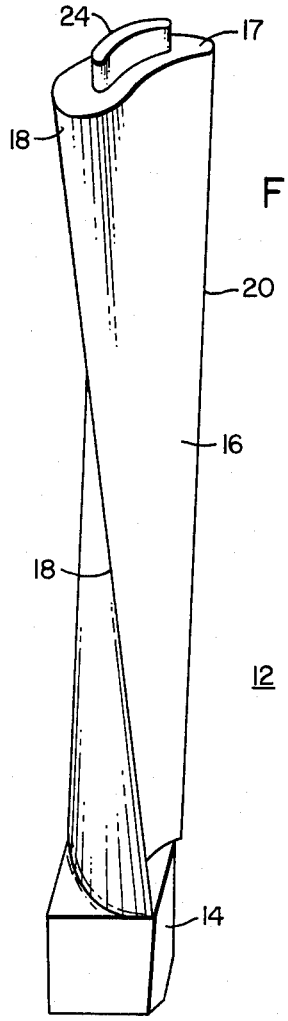
FIG. 1 is an elevational view of a twisted turbine blade.

Throughout the following description similar reference numerals refer to similar elements in all figures of the drawings.

Figure 2:
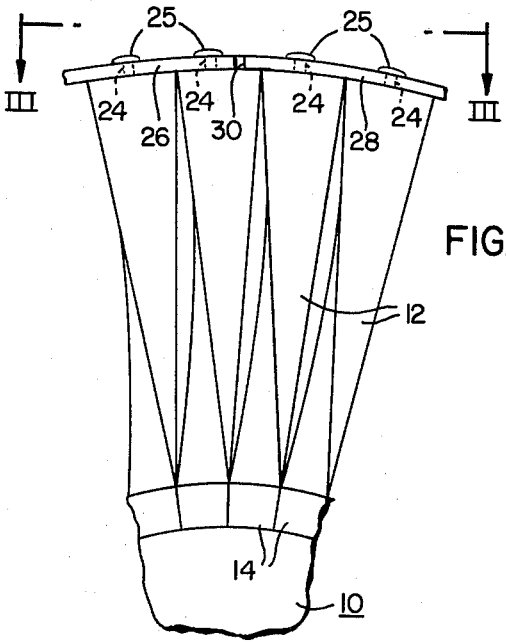
FIG. 2 is a partial prospective view of an annular array of twisted rotatable turbine blades, similar to that shown in FIG. 1, mounted on a rotor member.
Figure 3:
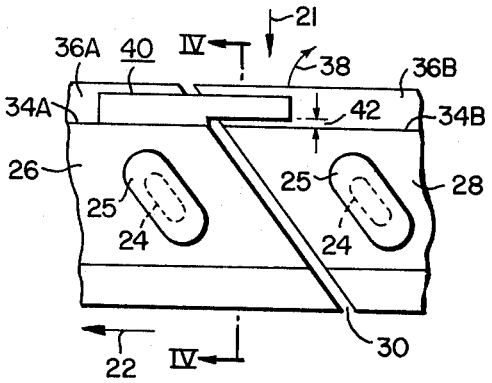
FIG. 3 is a view substantially along lines III—III of FIG. 2.

Referring now to the drawings, and especially to FIGS. 1 and 2, a rotor generally indicated by reference numeral 10 has mounted thereon an annular array of substantially radially-extending twisted blades 12 similar to that shown in isolation in FIG. 1, a segment of which bladed rotor 10 is shown in FIG. 2. Each blade 12 comprises a root portion 14 which is engaged by the rotor 10, and a substantially radially extending air foil portion 16 emanating from the root 14 and terminating in a tip 17. Each of the air foil portions 16 is a generally twisted member having a leading edge 18 and a sharper trailing edge 20 thereon. The curvature and angle of the air flow portion 16 changes and one proceeds radially outward from the root 14 so as to more efficiently extract energy from high temperature motive fluid which is directed on the blade 12. As seen in FIG. 3, the flow of motive fluid, indicated by reference arrow 21, is directed from a plurality of nozzles (not shown) onto the air foil portion 16 of the rotating blades 12. In response to the imposition of said motor fluid, the rotor member rotates in a direction substantially as shown by reference numeral 22.

Extending radially outward from the tip 17 of each rotating blade 12 is a tenon 24. As seen in FIGS. 2 and 3, a predetermined number of tenons 24 are engaged by a first and a second shroud ring, 26 and 28 respectively each tenon 24 being secured to the shroud ring by a rivet 25, where engagement of a predetermined number of tenons 24 by the rings 26 and 28 providing segmented groupings of rotational blades 16 within the annular array of blades founded on the rotor 10. It will be understood that although only portions of two such segments are shown in FIG. 2, the teachings of this invention are applicable to any number of segments comprising any number of rotating blades grouped together by suitable shrouds.

Figure 4:
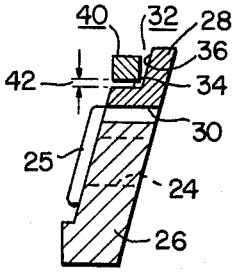
FIG. 4 is a sectional view of the invention taken along section lines IV—IV of FIG. 3; and, FIG. 5 is a view similar to FIG. 3 illustrating the invention.

A substantially axial cut 30 is disposed between the circumferential termini of the first shroud 26 and the second shroud 28. Referring especially to FIG. 4, a circumferential step 32 comprising a substantially radially extending face 34 and an axially extending lip 36 is provided on each of the shrouds 26 and 28, the numerals 34A and 34B representing the faces disposed on the first shroud 26 and the second shroud 28, respectively, while numerals 36A and 36B represent the lips disposed on the respective shrouds 26 and 28.

As is well known to those skilled in the art, during operation of the rotor 10 having a plurality of twisted blades 12 mounted thereon, centrifugal forces imposed on the rotor impart an untwist motion generally in a direction indicated in FIG. 3 by reference numeral 38. As viewed in FIG. 3, the motion occurs in a generally clockwise direction so as to eliminate the twist in the air foil 16 of each of the rotating blades 12. This untwist force imposed during operation of the rotor 10 imposes significant forces on the tenons 24 and rivets 25 which attach each individual blade 12 to its shroud member 26 or 28. If left unchecked, the bending that occurs within each tenon 24 of each blade within the group could severely damage the segment of grouped blades 12 and render them less effective for the conversion of energy.

Figure 5:
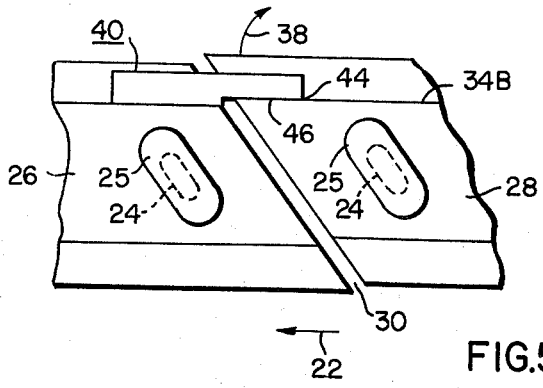

In order to inhibit the untwist motion imposed on the twisted blades 12 by centrifugal forces of operation, a snubber member, generally indicated by reference numeral 40 is disposed along the radially outward surface of the shrouds 26 and 28. As best seen in FIG. 3, the snubber 40 is securely affixed by suitable means, such as brazing or welding, to the face 34A on the first snubber 26. A portion of that snubber 40 extends, as shown in FIG. 3, so as to circumferentially overlap a portion of the second shroud 28. A predetermined axially clearance 42, the magnitude of which is a function of the untwist forces imposed on the blades, is disposed between the face 34B on the second shroud 28 and the snubber 40. As the untwist force 38 is imposed upon the twisted blades in each segment, the clearance 42 between the snubber 40 and the face 34B on the second shroud 28 closes, so that an abutment 44, illustrated in FIG. 5, therebetween occurs. The abutment 44 of the snubber 40 and the face 34B of the second shroud 28 inhibits further untwist motion to eliminate or significantly reduce the bending forces imposed upon the tenons 24. At the same time, as seen in FIG. 5, a frictional interface 46 at the abutment 44 inhibits motion in a circumferential direction, that is in the direction of rotation 22, between the adjacent shrouds 26 and 28.

It may be appreciated that the disposition of the vibration snubber damper 40 on the axially upstream side of a first shroud member 26 so as to circumferentially overlap a portion of an adjacent shroud 28 and to define a predetermined axially clearance 42 between the second shroud 28 and the snubber 40 will, in operation, tend to narrow the gap 42 therebetween and create an abutment 44 which inhibits further untwist forces imposed upon the blades 12 and at the same time create a frictional interface 46 to inhibit circumferential motion between adjacent blade groups.

I claim as my invention:

1. A rotor having an annular array of substantially radially extending twisted blades thereon, each of said blades having a radially outwardly extending tenon thereon, a first and a second shroud member extending circumferentially about said array, each shroud member engaging a predetermined plurality of tenons to define a first and a second blade group within said annular blade array, a substantially axial gap disposed between said shroud members, said first and said second shrouds each having a circumferential step thereon, said steps defined by a substantially radial face and a substantially axial lip disposed on each shroud, a snubber member disposed on said circumferential step on said first shroud, a portion of said snubber extending across said axial gap and circumferentially overlapping a portion of said circumferential step on said second shroud, a predetermined axial clearance being defined between said snubber and said radial face on said second shroud, said axial clearance closing so as to cause abutment between said second shroud and said snubber as said annular array of twisted blades is subjected to an untwist force during operation of said rotor, said abutment of said snubber and said second shroud inhibiting untwisting of said blades due to said untwist force and simultaneously providing a friction interface to limit circumferential motion between said snubber and said second shroud.

2. The rotor of claim 1, wherein said shrouds each have an axially upstream edge thereon, said step being disposed on said axially upstream edge of said shrouds.

3. The rotor of claim 1, wherein said snubber is mounted to said radial face on said first shroud.

4. The rotor of claim 1, wherein a substantially radial clearance is defined between said extending portion of said snubber and said axial lip on said second shroud.

5. The rotor of claim 3, wherein said snubber is radially coextensive within said radial face on said first shroud.

* * * * *